US006520942B1

(12) United States Patent
Putman

(10) Patent No.: US 6,520,942 B1
(45) **Date of Patent: *Feb. 18, 2003**

(54) METHOD TO IMPROVE PERI-ANAL HYGIENE AFTER A BOWEL MOVEMENT

(76) Inventor: Edward L Putman, 2 Rheel St., Vernon, CT (US) 06066

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 528 days.

(21) Appl. No.: 08/958,182

(22) Filed: Oct. 27, 1997

(51) Int. Cl.[7] ..... A61M 35/00; A61I 3/00
(52) U.S. Cl. ..... 604/290; 604/289; 134/6
(58) Field of Search ..... 604/289, 290, 604/305, 19; 4/DIG. 9, 224, 448, 661; 222/183, 184, 205, 402.13; 424/402, 404, 653

(56) References Cited

U.S. PATENT DOCUMENTS 3,577,516 A * 5/1971 Gould et al. ..... 904/290
3,776,773 A * 12/1973 Taft ..... 134/6
3,780,908 A * 12/1973 Fitzpatrick et al. ..... 221/48
3,865,271 A * 2/1975 Gold ..... 222/193
3,966,095 A 6/1976 Chapell ..... 222/384
4,087,022 A * 5/1978 Zanetti-Streccia ..... 222/183
4,118,480 A 10/1978 Williams ..... 424/653
4,441,219 A 4/1984 Epstien ..... 4/448
4,451,943 A 6/1984 Nibler ..... 4/661
4,853,281 A 8/1989 Win ..... 428/286
5,044,556 A 9/1991 Suzuki ..... 239/135
5,381,568 A 1/1995 Warkentin ..... 4/224
5,435,465 A 7/1995 El-Amin ..... 222/108
5,436,007 A 7/1995 Hartung ..... 424/402
5,753,246 A * 5/1998 Peters ..... 424/404

* cited by examiner

*Primary Examiner*—Kim M. Lewis
(74) *Attorney, Agent, or Firm*—Timothy J. Olson

(57) ABSTRACT

A gel is bottled in a plastic container and the top fitted with a pump for delivery of a small quantity of the gel onto dry toilet paper. The gel can thus be hygienically applied to the peri-anal area using the thus moistened toilet paper, and the area wiped dry with a second piece of toilet paper. The method leaves a clean comfortable derriere without skin abrasive rubbing. The applicator, being nothing but ordinary toilet paper, is flushable without question.

6 Claims, No Drawings

METHOD TO IMPROVE PERI-ANAL HYGIENE AFTER A BOWEL MOVEMENT

BACKGROUND—Field of Invention

This invention relates to peri-anal hygiene especially to an improved method of wiping the anal area clean following a bowel movement.

BACKGROUND—Description of Prior Art

Following a bowel movement some residual fecal particles remain around the anus. The particles become a source of odor and may cause irritation of the skin if the particles are not removed.

It is customary in Western Nations to wipe the area clean with dry toilet paper or another available material. A dry wipe of this nature is not effective against odor, and often some particles remain to cause irritation, odor and soiled clothing.

In India and some other Eastern Nations water is used to wash the area clean using the hand for application. This procedure is effective, especially if soap is included in the wash, but the consequences of hand application is not accepted by most Western countries. Bidets are available for the purpose, some of which spray the water onto the anal area. Bidets and other water based cleansing systems are a burdensome addition to a home toilet, and appear to be less than sanitary when placed in public bathrooms.

Recently moist toilet wipes have been placed on the market. These are flushable wipes which are manufactured with a wet coating and packaged in plastic containers which intends to maintain the moisture within the paper. The disadvantage of these wipes is that they are clammy to the touch, made of material which is less conducive to flushing than regular toilet paper, and not convenient to carry when away from home. Because the paper must remain for a long time in moisture prior to use it often flakes when used, leaving an unpleasant after-affect.

Inventions exist which moisten the toilet paper with water just prior to use, but regular toilet paper, by design, loses its consistancy immediatly when water is applied, and these inventions have not proven practical.

The state of the art prior to this invention, the above inventions not withstanding, requires most Westerners to rely on dry toilet paper to remove the fecal particles, and to rely on undercloths to suppress the odor until a bath or shower is taken.

OBJECTS AND ADVANTAGES

Accordingly, several objects and advantages of my invention are to provide a convenient and practical method for cleaning the particles and odor from the peri-anal part of the body following a bowell movement, to provide a method that can be available to the user regardless of which toilet he is using, to provide a method that will alleviate irritation caused by dry paper wiping, to provide a method that will not need rinsing, to provide a method that will not dampen nor stain undergarments.

Still further objects and advantages will become apparent from a consideration of the ensuing description.

BRIEF DESCRIPTION OF THE DRAWINGS

There are no drawings provided.

Reference Numerals

Not applicable.

SUMMARY

A method to improve peri-anal hygiene comprising a gel of consistancy sufficient to rest for several seconds on toilet paper without disintegrating the paper, said gel being bottled in a plastic container with a delivery system which allows a small quantity of the gel to be extracted from the bottle using one hand and said gel placed onto a piece of toilet paper held in the second hand, said second hand then applies the gel to the peri-anal area and discards the said paper in the toilet for later flush, a second piece of toilet paper is then used to wipe the peri-anal area dry and again discarded, it being understood that the moistening and drying steps may be repeated until the peri-anal area is comfortably clean of fecal particles and odor.

PREFERRED EMBODIMENT—Description

A gel whose base is aloe vera is packaged in a commercially available plastic bottle sufficient to contain eight (8) fluid ounces of the gel. A commercially available gel pump allows for gel extraction directly on a crumpled piece of regular toilet paper. The toilet paper remains consistant due to the thickness of the gel, and the anal area may now be wiped effectively and comfortably with the gel dampened paper. A second piece of toilet paper is then used without gel in order to wipe dry the gel remaining around the anal area. The composition of the gel is such that it cleanses without leaving any odor of its own. Eight fluid ounces of gel provides cleansing for one hundred and twenty occasions.

PREFERRED EMBODIMENT—Operation

In operation a gel must be designed or selected which will have sufficient viscosity to be able to rest for several seconds on ordinary toilet paper without noticeably disintegrating the paper. The gel must also have a cleansing affect on skin tissue without requiring a water rinse. The gel must leave no uncomfortable after sensation and when dry must not stain under garments The gel must not irritate the skin.

The ingredients of the preferred embodiment are shown below.

Aloe Vera Gel, Water, Propylene Glycol, DMDM Hydantoin, Caropol, TEA, Germall.

CONCLUSIONS, RAMIFICATIONS, AND SCOPE

Accordingly, it can be seen that use of a well formulated cleansing gel can by applied by ordinary toilet paper and wiped dry with a second piece of the same toilet paper, thus providing a practical method for improving anal hygiene following a bowell movement.

Although the description above contains many specificities, these should not be construed as limiting the scope of the invention but as merely providing illustrations of some of the presently preferred embodiments of this invention. Various other embodiments and ramifications are possible within it's scope. For example, the possibilities for bottling the gel with respect to volume and delivery systems are boundless. Perfumes, if proven safe, may be added. Small amounts of oils (such as vitamin E or mineral oil) to effect a soothing sensation without hampering the cleansing action substantially. Ramifications Thus the scope of the invention should be determined by the appended claims and their legal equivalents, rather than by the examples given.

What is claimed is:

1. A method to improve peri-anal hygiene comprising:

providing a gel of viscosity thick enough to rest for several seconds on a piece of toilet paper without causing noticeable disintegration of the piece of toilet paper;

dispensing a quantity of the gel onto the sheet of toilet paper;

applying the gel to an anal area using the sheet of toilet paper as an applicator; and wiping the anal area with a dry sheet of toilet paper to dry the anal area of moisture left by said applying the gel.

2. A method to improve peri-anal hygiene comprising:

dispensing a gel onto a piece of toilet paper using a gel pump, the gel having a viscosity of sufficient thickness to prevent noticeable disintegration of a portion of the piece of toilet paper when the gel is applied to the portion; and wiping an anal area with the gel using the piece of toilet paper as an applicator.

3. The method of claim 2, further including:

storing the gel in a container, the gel pump being secured to the container.

4. The method of claim 2, further including:

wiping the anal area with a dry piece of toilet paper for substantially drying the anal area of moisture left by said wiping the anal area with the gel.

5. An apparatus for improving peri-anal hygiene comprising:

a gel pump attached to a container; and a gel applied to a portion of a piece of toilet paper by said gel pump, said gel having a viscosity of sufficient thickness to prevent noticeable disintegration of said portion of said piece of toilet paper when said gel is applied to said portion.

6. The apparatus of claim 5, wherein:

said gel comprises Aloe Vera gel.

* * * * *

US006520942C1

(12) EX PARTE REEXAMINATION CERTIFICATE (5197th)

United States Patent

Putman

(10) Number: US 6,520,942 C1

(45) Certificate Issued: Sep. 6, 2005

(54) METHOD TO IMPROVE PERI-ANAL HYGIENE AFTER A BOWEL MOVEMENT

(75) Inventor: Edward L. Putman, 2 Rheel St., Vernon, CT (US) 06066

(73) Assignee: Edward L. Putman, Vernon, CT (US)

( * ) Notice: This patent issued on a continued prosecution application filed under 37 CFR 1.53(d), and is subject to the twenty year patent term provisions of 35 U.S.C. 154(a)(2).

Reexamination Request:
No. 90/006,758, Sep. 24, 2003

Reexamination Certificate for:

| | |
|---|---|
| Patent No.: | **6,520,942** |
| Issued: | **Feb. 18, 2003** |
| Appl. No.: | **08/958,182** |
| Filed: | **Oct. 27, 1997** |

(51) Int. Cl.[7] ..... A61M 35/00; B08B 7/00; A01N 25/34; A01N 65/00; A61K 7/50

(52) U.S. Cl. ..... 604/290; 604/289; 134/6; 424/404; 424/744; 510/137; 510/158

(58) Field of Search ..... 604/289, 290, 604/364, 19; 4/DIG. 9, 222, 442, 661; 222/183, 184, 205, 402.13; 424/402, 404, 653, 744; 510/137, 138, 158; 206/77.1, 438, 229, 812, 823; 15/118, 208, 209.1

(56) References Cited

U.S. PATENT DOCUMENTS

| | | | | | |
|---|---|---|---|---|---|
| 3,495,571 | A | * | 2/1970 | Evans | 118/325 |
| 3,634,259 | A | * | 1/1972 | Evans | 510/137 |
| 3,865,271 | A | * | 2/1975 | Gold | |
| 4,472,376 | A | * | 9/1984 | Kamishita | |
| 4,657,691 | A | * | 4/1987 | Hara et al. | 15/104.93 |
| 4,708,873 | A | * | 11/1987 | Schulte | 424/744 |
| 4,820,698 | A | * | 4/1989 | Degenhardt et al. | 514/102 |
| D352,657 | S | * | 11/1994 | Gonda et al. | D9/300 |
| 5,487,899 | A | * | 1/1996 | Davis | |
| 5,661,170 | A | * | 8/1997 | Chodosh | 514/390 |
| 5,692,302 | A | * | 12/1997 | Martin et al. | 30/41 |
| 6,565,850 | B2 | * | 5/2003 | Blanco | 424/769 |

FOREIGN PATENT DOCUMENTS

| | | | | | |
|---|---|---|---|---|---|
| JP | 03149020 | A | * | 6/1991 | A47K/7/00 |

OTHER PUBLICATIONS

New Sea Breeze Facial Cleansing Gel Ad, Vogue, Oct. 1988, p. 179.*

Aloe Vera, Drug and Cosmetic Industry, Nov. 1985, p. 48.*

Roeder, Giselle, Skin Care & Aloe Vera, Total Health, v. 16, n. 3, (Jun. 1994).*

* cited by examiner

*Primary Examiner*—Karin M. Reichle

(57) ABSTRACT

A gel is bottled in a plastic container and the top fitted with a pump for delivery of a small quantity of the gel onto dry toilet paper. The gel can thus be hygienically applied to the peri-anal area using the thus moistened toilet paper, and the area wiped dry with a second piece of toilet paper. The method leaves a clean comfortable derriere without skin abrasive rubbing. The applicator, being nothing but ordinary toilet paper, is flushable without question.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *